US005601963A

United States Patent [19]

Filosa et al.

[11] Patent Number: 5,601,963

[45] Date of Patent: Feb. 11, 1997

[54] SILVER HALIDE EMULSIONS

[75] Inventors: Michael P. Filosa, Medfield; Zbigniew J. Hinz, Melrose; Mark T. Spitler, Concord, all of Mass.

[73] Assignee: Polaroid Corporation, Cambridge, Mass.

[21] Appl. No.: 673,328

[22] Filed: Jun. 28, 1996

[51] Int. Cl.[6] ..... G03C 1/18; G03C 1/26; G03C 8/06; G03C 8/10

[52] U.S. Cl. ..... 430/217; 430/230; 430/578; 430/944

[58] Field of Search ..... 430/217, 230, 430/578, 944

[56] References Cited

U.S. PATENT DOCUMENTS

| | | | |
|---|---|---|---|
| 3,632,349 | 1/1972 | Shiba et al. | 430/578 |
| 3,955,996 | 5/1976 | Hinata et al. | 96/129 |
| 4,387,155 | 6/1983 | Hill et al. | 430/217 |
| 5,254,455 | 10/1993 | Hinz et al. | 430/584 |
| 5,415,978 | 5/1995 | Asami et al. | 430/363 |
| 5,508,161 | 4/1996 | Miyake et al. | 430/574 |

OTHER PUBLICATIONS

Kiprianov, A. I., Yagupolsky, L. M., "Cyanine Dyes Containing Fluorine," J. Chem. USSR, 20, 2111; Eng. Trans. 2187 (1950).

*Primary Examiner*—Richard L. Schilling
*Attorney, Agent, or Firm*—Jennifer A. Kispert

[57] ABSTRACT

This invention relates to photographic light-sensitive silver halide emulsions wherein the silver grains are spectrally sensitized to near infrared radiation at wavelengths above 700 nm with a particular class of cyanine dyes and to photographic elements and film units employing such emulsions.

25 Claims, No Drawings

SILVER HALIDE EMULSIONS

BACKGROUND OF THE INVENTION

The present invention relates to photographic light-sensitive silver halide emulsions wherein the silver halide grains are spectrally sensitized to near infrared radiation at wavelengths above 700 nm with a J-band type sensitizing dye of a particular class of cyanine dyes and to photographic elements and film units employing these emulsions.

It is well known in the photographic art that the photosensitive response of silver halide emulsions can be extended to longer wavelengths by the addition of spectral sensitizing dyes, notably cyanine dyes. This technique has been employed to sensitize silver halide emulsions to a specific wavelength region in the visible and also the infrared portion of the electromagnetic spectrum and has been widely used in the production of photosensitive elements for color photography which comprise a plurality of spectrally sensitized emulsion layers that respond to different wavelength regions of the spectrum. This technique also has been employed in the production of panchromatically sensitized emulsions, generally by employing a combination of sensitizing dyes to provide the requisite sensitivity over the wavelength range of about 400 to 650 nm.

Various cyanine dyes have been used to spectrally sensitize photographic light-sensitive silver halide emulsions, for example: (1) symmetrical and unsymmetrical cationic cyanine dyes obtained from derivatives of 6-fluorobenzothiazole, see Kiprianov and Yagupolsky in J. Chem. USSR, 20, 211: Eng. Trans. 2187 (1950); (2) a spectral sensitizing dye having an amidinium ion auxochrome and numerous cyanine dyes including symmetrical and unsymmetrical polymethine dyes of fluoro-substituted benzothiazoles, see U.S. Pat. No. 3,955,996; (3) unsymmetrical cyanine dyes useful as green sensitizing dyes which possess a benzoxazole nucleus and a 5-fluorobenzothiazole nucleus, see U.S. Pat. No. 4,387,155; (4) pentamethine cyanine dyes of 5-fluorobenzothiazole derivatives useful as the infrared sensitizing dyes above 800 nm, see U.S. Pat. No. 5,254,455; and (5) a rigidized pentamethine dye, see U.S. Pat. No. 5,415,978.

In addition, combinations of two or more cyanine dyes have also been used to spectrally sensitize photographic light-sensitive silver halide emulsions, for example:

(1) U.S. Pat. No. 3,632,349 (issued Jan. 4, 1972) discloses a spectrally sensitized silver halide photographic emulsion whose spectral sensitivity in the red region is raised by supersensitization, i.e., the combination of at least two kinds of sensitizing dyes represented therein by formula (I) and (II), respectively; see column 1, lines 74–75. The dye of formula (I) therein J-aggregates and a suitable spectral sensitivity distribution may be given; see column 3, lines 28–29. By contrast, the dye of formula (II) therein, which may have a furyl group at the number 9-carbon of the dye (see column 2, line 44) and must have at least one sulfo-substituted alkyl group on the resonating terminal nitrogen atom in the heterocyclic nucleus (see column 2, lines 69–70), shows a very weak spectral sensitizing action when used alone, see column 2, line 75 to column 3, line 2; and (2) U.S. Pat. No. 5,508,161 (issued Apr. 16, 1996) discloses a photographic silver halide photosensitive material which includes an infrared sensitive layer which is spectrally sensitized with a combination of at least two J-band type sensitizing dyes so as to have maximum spectral sensitivity of at least 700 nm; see column 4, lines 12–13.

The benefits of the invention of aforementioned U.S. Pat. No. 5,508,161, e.g., high sensitivity in the infrared region (see column 3, line 63), are obtained only when two or more J-band type sensitizing dyes are combined, but not achieved when J-band type sensitizing dyes are used singly; see column 5, lines 37–43. These patentees state that only a few J-band type sensitizing dyes having a maximum absorption wavelength of 700 nm or longer are known (see column 5, lines 48–55) and, that, after making extensive investigations of the art on J-band type sensitizing dyes having a maximum absorption wavelength of 700 nm or longer, they decided to utilize a combination of dyes rather than a single sensitizing dye to attain the desired sensitization, i.e., at least 700 nm or longer wavelength; see column 5, lines 56–59.

Although the known sensitizing dyes referred to above have generally provided suitable speed and stability at the desired wavelengths; nevertheless, the sensitizing dyes of choice for above 700 nm sensitization have routinely imparted instability and undesirable photographic speed to the sensitized photographic system. Therefore, additional research is necessary to find a solution to this stability problem without compromising the speed of and extent of sensitization by these dyes of choice.

Accordingly, the present invention provides a class of J-band type sensitizing dyes having maximum absorption wavelength above 700 nm to achieve the desired sensitization. More particularly, the present invention provides photographic light-sensitive silver halide emulsions wherein the silver halide grains are spectrally sensitized to near infrared radiation at wavelengths above 700 nm with a J-band type sensitizing dye of a particular class of cyanine dyes resulting in suitable speed, extent of sensitization and stability when used in photographic systems.

SUMMARY OF THE INVENTION

The present invention provides photographic light-sensitive materials, particularly photographic light-sensitive silver halide emulsions spectrally sensitized to infrared radiation above 700 nm with a J-band type sensitizing dye of a particular class of cyanine dyes.

The subject dyes are benzothiazole carbocyanines substituted with electron-donating groups in the four, five and six positions on the benzothiazole ring, methyl groups on the quaternary and ternary nitrogen atoms, and a furan ring connected from the number 2-carbon of the furan ring to the number 9-carbon of the dye. The methyl groups on the quaternary and ternary nitrogen atoms do not interfere with the subject dye's ability to J-aggregate on the silver halide surface nor degrade the subject dye's performance. The use of a furan substituent on the meso-carbon of the trimethine chain induces a bathochromic shift of the dye chromophore. These chain substituents along with the electron-donating substituents on the benzothiazole rings further the bathochromic shift of the chromophore making it a useful sensitizer for the near infrared region.

The preferred dyes of the subject class are benzothiazole carbocyanines with electron-donating groups in the 5- and 6-positions of the benzothiazole rings and a 2-furan substituent on the meso-carbon of the trimethine chain; more specifically, preferred compounds have methoxy groups on the 5,6,5'-positions of the benzothiazole ring or have methoxy groups on the 5,6-positions and a chloro group in the 5'-position of the benzothiazole ring. As will be apparent to one of skill in the art, replacing the 5'-methoxy group with a chloro group not only reduces the bulk of the molecule but results in a small hypsochromic shift in solution. Furthermore, the presence of the chloro group slightly improves both the sensitization envelope and the stability performance of the dye.

The subject dyes may be readily incorporated into a wide variety of photographic silver halide emulsion systems for use in both black-and-white and color imaging. Further, the coated photosensitive emulsions exhibit excellent speed in the infrared region of the spectrum as well as good sensitivity in the blue region of inherent sensitivity and retain these sensitivities on prolonged storage at room temperature (RT). In addition, the resulting emulsions, besides possessing high sensitivity in the infrared, exhibit good stability against fogging before, during and after coating.

Further, it has been found that the subject dyes can be used advantageously alone to provide the above-mentioned high sensitivity in the infrared, stability and speed. Moreover, the use of a single sensitizing dye to achieve the desired sensitization as opposed to a combination of two or more sensitizing dyes decreases both the technical complexity and the expense associated with the production of photographic systems employing such silver halide emulsions.

It is, therefore, among the objects of the present invention to provide photographic light-sensitive silver halide emulsions spectrally sensitized to radiation in the infrared region of the electromagnetic spectrum above 700 nm with a J-band type sensitizing dye of a particular class of cyanine dyes and photographic elements and film units comprising such emulsions.

DETAILED DESCRIPTION OF THE PREFERRED EMBODIMENTS

It has been found that meso-furan trimethine cyanine dyes, represented by formula (I), form stable J-band aggregates and thus, are effective as near infrared spectral sensitizing dyes

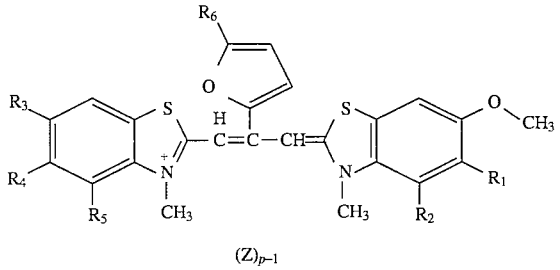

(I)

wherein:

$R_1$ is methoxy or halogen;

$R_2$ is hydrogen;

$R_3$ is hydrogen or methoxy;

$R_4$ is methoxy;

$R_5$ is hydrogen;

$R_6$ is hydrogen or an alkyl group ($C_nH_{2n+1}$ wherein n is an integer from 1 to 4;

$R_1$ and $R_2$ or $R_4$ and $R_5$, taken together, can represent a saturated or unsaturated, 5- or 6-membered carbocyclic or heterocyclic ring wherein the heteroatom is sulfur or oxygen;

Z is a photographically-acceptable counterion as needed to balance the charge of the molecule such as sodium, potassium, ammonium, iodide, bromide, p-toluene sulfonate ($OTs^-$), triethylammonium, triethanolammonium, trifluoromethane sulfonate (OTf) and pyridinium; and p is 1 when the molecule is not positively charged; or p is greater than 1 when the molecule is positively charged.

In a preferred embodiment of the present invention, $R_1$, $R_3$ and $R_4$ are methoxy, $R_2$, $R_5$ and $R_6$ are hydrogen and p is 1. In a particularly preferred embodiment, $R_1$ is chloride, $R_2$, $R_5$ and $R_6$ are hydrogen, $R_3$ and $R_4$ are methoxy and p is 1.

The dyes of formula (I) herein have methyl groups on the quaternary and ternary nitrogen atoms. By contrast, the dye represented by formula (II) of aforementioned U.S. Pat. No. 3,632,349 must have at least one sulfo-substituted alkyl group on the resonating nitrogen atom in the heterocyclic nucleus. Further, unlike in the present invention, the dye of formula (II) therein shows a very weak spectral sensitizing action when used alone. Although not fully understood, it is believed that the advantages of the present invention are realized in part by the use of methyl groups on the quaternary and ternary nitrogen atoms.

Photographic light-sensitive silver halide emulsions wherein the silver halide grains are spectrally sensitized to near infrared with a dye(s) of formula (I) herein exhibit desirable extents of sensitization, stability and speed. In addition, the sensitivity is retained on prolonged storage at RT. Furthermore, as stated earlier, it has been found that the subject dyes can be used advantageously alone to provide the above-mentioned high sensitivity in the infrared, stability and speed. The use of a single J-band type sensitizing dye as opposed to a combination of two or more sensitizing dyes (see aforementioned U.S. Pat. Nos. 3,632,349; and 5,508,161) decreases both the technical complexity and the expense associated with the production of photographic systems employing such silver halide emulsions.

The dyes of formula (I) herein can be: (1) applied to the sensitization of silver halide emulsions to be used for various color or black-and-white photographic processes for forming an image in dye or in silver, (2) incorporated into a photographic silver halide emulsion in a conventional manner and (3) dispersed directly, or dissolved in a suitable solvent such as water, methanol, ethanol, acetone, trifluoroethanol, methyl cellusolve pyridine or a mixture thereof and added as a solution for uniformly distributing the dye throughout the emulsion.

It is preferred to use a single subject dye to sensitize the silver halide emulsions. The amount of sensitizing dye employed is from about 0.5 to about 2.5 mg of dye per gram of silver. The preferred amount of sensitizing dye employed in the present invention is from about 1.0 to about 1.2 mg of dye per gram of silver. The optimum amount of subject sensitizing dye(s) for a given emulsion for use in a given photographic system may be readily determined by routine testing.

The silver halide emulsion employed can be produced using techniques known in the art and can contain as the silver halide component, for example, silver chloride, silver bromide, silver iodide, silver chlorobromide, silver chloroiodide, silver bromoiodide or silver chlorobromoiodide. Such emulsions can be coarse, medium or fine grain or a mixture thereof, and the silver halide grains may have any configuration, uniform or irregular.

It is preferred to use gelatin as the binder for the emulsion. However, the gelatin may be used in admixture with or replaced by other materials, gelatin derivatives, cellulose derivatives, or by synthetic polymeric materials such as, polyvinylalcohol, polyvinylpyrrolidone, and the like.

The silver halide emulsion can be chemically sensitized using chemical sensitizers (e.g. sulfur, selenium, tellurium compounds; gold, platinum, palladium compounds; reducing agents such as tin chloride, phenylhydrazine, reductone, etc.) and may contain other additives as discussed in Research Disclosure No. 17643, December 1978.

Illustrative of such additives are antifoggants and stabilizers (e.g. noble metal salts, mercury salts, oximes, sulfocatechols, mercapto compounds, thiazolium compounds, urazoles, triazoles, azaindenes, etc.); hardening agents (e.g. aldehyde compounds, ketone compounds, active halogen compounds, active olefin compounds, carboxylic and carbonic acid derivatives, dioxane derivatives, aziridines, isocyanates, epoxy compounds, carbodiimides, etc. and inorganic compounds such as chrome alum and zirconium sulfate); speed increasing compounds (e.g. polyalkylene glycols, thioethers, cationic surface active agents, etc.); coating aids (e.g. natural surfactants such as saponin, nonionic surfactants such as alkylene oxide derivatives, cationic surfactants such as quaternary ammonium salts, anionic surfactants having an acidic group such as a carboxylic, sulfonic or phosphoric acid group and amphoteric surfactants such as amino acids and aminosulfonic acids); and plasticizers and lubricants (e.g. polyalcohols, fatty acids and esters, silicone resins and the like).

Photographic elements including emulsions sensitized in accordance with the present invention also may contain other materials such as optical brightening agents, matting agents, anti-static agents and light-absorbing materials, e.g., antihalation and color correction filter dyes.

The photographic elements also can contain developing agents such as, hydroquinones, catechols, aminophenols, 3-pyrazolidones, substituted hydroxylamines, reductones and phenylenediamines or combinations thereof. The developing agents can be contained in the silver halide emulsion and/or in another suitable location. Depending upon the particular photographic system, the developing agent may be used as an auxiliary developer or as a color-forming developer where a color-forming coupler also may be included in the photographic element.

Emulsions spectrally sensitized in accordance with the present invention can be coated on a wide variety of supports, for example, glass, paper, metal, cellulose acetate, cellulose nitrate, polyvinylacetal, polyethylene, polyethylene terephthalate, polyamide, polystyrene, polycarbonate, etc. The emulsion can be coated on the support by various coating procedures including dip coating, air knife coating, curtain coating, extrusion coating, etc.

Exposure for obtaining a photographic image may be conducted in a conventional manner. That is, any of various known light sources emitting light rays including infrared rays may be employed such as natural sunlight, a tungsten lamp, a cathode ray tube, light-emitting diodes (LEDs) and laser light (e.g., from a gas laser, YAG laser, dye laser, semiconductor laser, etc.). Also, exposure may be effected by using light emitted from a fluorescent body excited with electron beams, X-rays, gamma-rays, a-rays or the like.

While useful in a variety of photographic processes, emulsions spectrally sensitized in accordance with the present invention are particularly useful in diffusion transfer photographic systems for providing silver or color images. These photographic processes are now well known and need not be described in detail here.

Briefly, color image formation in diffusion transfer processes relies upon a differential in mobility or solubility of an image dye-providing material obtained as a function of imagewise development of an exposed silver halide emulsion so as to provide an imagewise distribution of such material which is more diffusible and which, therefore, may be selectively transferred to an image-receiving layer comprising a dyeable stratum to impart thereto the desired color transfer image. The differential in mobility or solubility may be obtained, for example, by a chemical action such as a redox reaction, a silver-ion assisted cleavage reaction or a coupling reaction.

Image dye-providing materials which may be employed generally may be characterized as either (1) initially soluble or diffusible in the processing composition but are selectively rendered non-diffusible in an imagewise pattern as a function of development; or (2) initially soluble or non-diffusible in the processing composition but which are selectively rendered diffusible or provide a diffusible product in an imagewise pattern as a function of development. The image dyeproviding materials may be complete dyes or dye intermediates.

Examples of initially soluble or diffusible materials and their application in color diffusion transfer processes are disclosed, for example, in U.S. Pat. Nos. 2,774,668; 2,968,554; 2,983,606; 3,087,817; 3,185,567; 3,230,082; 3,345,163; and 3,443,943. Examples of initially non-diffusible materials and their use in color diffusion transfer systems are disclosed in U.S. Pat. Nos. 3,185,567; 3,443,939; 3,443,940; 3,227,550; 3,227,551; 3,227,552; 3,227,554; 3,243,294; 3,445,228; 3,719,488; 3,719,489; and 4,076,529. The use of a hybrid system using an initially soluble or diffusible material, i.e., a dye developer for one or more colors in combination with an initially non-diffusible material, i.e., a thiazolidine compound that undergoes silver ion-assisted cleavage to release a diffusible dye for the other color(s) is disclosed in U.S. Pat. No. 4,740,448. It is preferred to use the hybrid color diffusion transfer system in the photosensitive element of the present invention.

As is now well known, film units employed in diffusion transfer processes for providing multicolor images comprise two or more selectively sensitive silver halide emulsion layers each having associated therewith the appropriate image dye-providing material. For full color (three-color) photography, these materials are preferably selected for their ability to provide colors that are useful in carrying out subtractive color photography, that is, cyan, magenta and yellow. Such film units also contain an image-receiving layer, i.e., the dyeable stratum; preferably, an acid-reacting reagent, e.g., a polymeric acid layer; and optionally, interlayers or spacer layers between the respective silver halide emulsion layers and associated image dye-providing materials, an interlayer or spacer layer between the polymeric acid layer and the dyeable stratum to control or "time" the pH reduction so that it is not premature and thereby interfere with the development process, overcoat layers and antihalation, subcoat, stripcoat and other layers.

In such film units, the photosensitive component comprising the silver halide emulsion layers, sometimes referred to as the "negative component" and the image-receiving component comprising at least the dyeable stratum, referred to as the "positive component" initially may be carried on separate supports (in which event they may be referred to as a photosensitive element and as a second sheet-like element or image-receiving element) which are brought together during processing and thereafter retained together as an integral negative-positive reflection print, or they may initially comprise a unitary structure wherein the negative and positive components are retained together prior to, during and alter image formation.

Rather than retaining the negative and positive components as an integral structure, the film unit may be designed so that the image-receiving or positive element is separated from the remaining layers of the film unit subsequent to processing in order to view the image.

In certain embodiments, also known in the art, the image-receiving layer is carried on the same support as the photosensitive element, and the second, sheet-like element may contain the timing and/or polymeric acid layers; such an element is sometimes referred to in the art as a cover sheet.

The liquid processing composition applied subsequent to imagewise exposure comprises at least an aqueous solution of an alkaline material, for example, sodium hydroxide or potassium hydroxide and preferably possesses a pH in excess of 12 and preferably includes a viscosity-increasing compound constituting a film-forming material, such as, hydroxyethyl cellulose, sodium carboxymethyl cellulose or polydiacetone acrylamide oxime. The processing composition is contained in a rupturable container or pod so positioned as to distribute the processing composition between the superposed sheets of the product or film unit. Alternatively, the alkaline material used in development may be generated in situ by alkali generating systems incorporated within the photographic system such as disclosed by copending, commonly-assigned U.S. Pat. appln. serial no. 08/607,680 and U.S. Pat. Nos. 3,260,598; 4,740,363; and 4,740,445.

Depending upon the particular image-dye providing materials and the particular diffusion transfer system, a developing agent such as those enumerated above; a silver halide solvent such as thiosulfates, uracils and thioether-substituted uracils; a light-absorbing optical filter agent such as the pH-sensitive phthalein dyes described in U.S. Pat. No. 3,647,437; and a light-reflecting material such as titanium dioxide also may be included in the processing composition and/or in an appropriate layer of the film unit. In addition, the processing composition may contain preservatives, restrainers, accelerators and other reagents as may be desired.

Whether the photosensitive element is intended for use in diffusion transfer or other photographic color imaging systems, it will be appreciated that an infrared sensitized silver halide emulsion of the present invention can be used in combination with silver halide emulsion(s) selectively sensitized to wavelengths in the visible and/or infrared region of the electromagnetic spectrum. For example, in the production of full color images, the other two emulsions used in combination with an infrared sensitized silver halide emulsion of the present invention can be sensitive, respectively to green and red portions of the visible region. Alternatively, one or both of the other two emulsions can be sensitized to other selected wavelengths in the infrared region (750–1500nm) as described in U.S. Pat. No. 4,619,892.

In a preferred embodiment, the photosensitive element comprises a support carrying, in sequence, a layer of a cyan image dye-providing material, an infrared sensitized silver halide emulsion, a layer of a magenta image dye-providing material, a red-sensitive silver halide emulsion, a layer of a yellow image dye-providing material, and a layer of a blue sensitive silver halide emulsion.

In a particularly preferred embodiment of the present invention, the cyan and magenta image dye-providing materials are dye developers, the yellow image dye-providing material is a thiazolidine, and exposure is effected using LEDs emitting light of the appropriate wavelengths, i.e., 650, 720 and 820 nm.

Such a combination of LEDs avoids the use of the less efficient blue and green LEDs. Furthermore, the usual red, green and blue records are used to provide the image information to activate the infrared, red and green LEDs in the known manner, thus providing a normal full color image.

The subject dyes can be synthesized in accordance with known procedures as described in the following organic syntheses (see Examples I and II herein) and as described in F. M. Hamer, The Cyanine Dyes and Related Compounds, Interscience Publishers, New York (1964).

Examples I and II provide methods of preparation for the dyes of formula (I) herein. Example III, i.e., photographic light-sensitive silver halide emulsions wherein the silver halide grains are spectrally sensitized to near infrared with a J-band type sensitizing dye according to formula (I) of the present invention, illustrates the desirable extents of sensitization, stability and speed of photographic emulsions utilizing a dye of formula (I). Examples I–III are intended to be illustrative only and the present invention is not limited to the materials, conditions, process parameters, etc. recited therein. All parts and percentages recited are by weight unless otherwise stated.

EXAMPLE I

Preparation of
3,3'-dimethyl-9-(2-furano)-5,6,5'6'-tetramethoxy
2,2'-thiacarbocyanine trifluoromethane sulfonate (II)

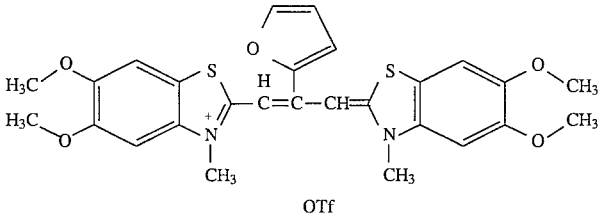

The following compounds were among those used in this example:

(a)

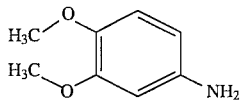

(b)

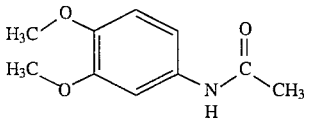

(c)

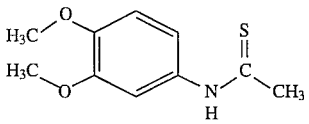

(d)

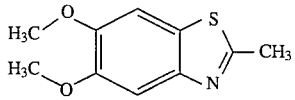

-continued (e)

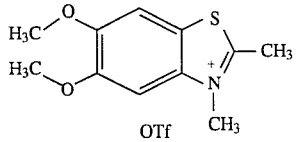

(f)

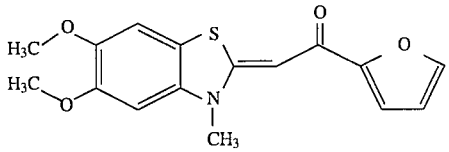

(g)

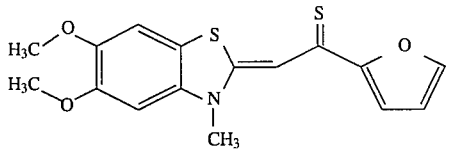

(h)

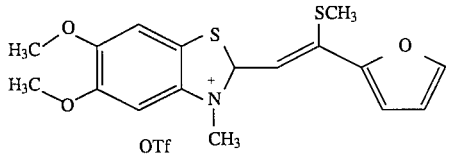

(i)

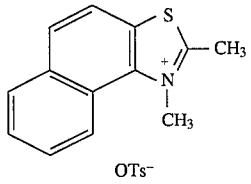

(j)

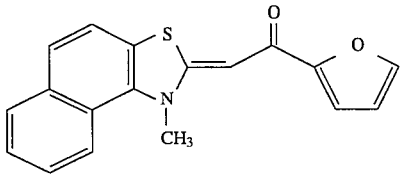

(k)

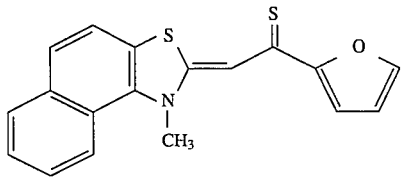

(l)

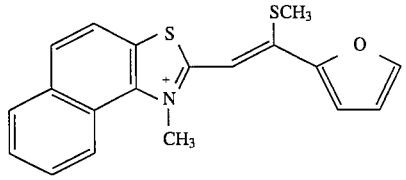

Compound (a) (150 g, 0.98M 4-aminoveratrol) was dissolved in stirred dimethylformamide (300 mL). Acetic anhydride (94.3 mL, 1.0M) was added over a period of 15 minutes (min.). The reaction was stirred for 6 hours (h), poured into 1.5 L of water and stirred for 30 min. during which time the acetanilide precipitated. The product was collected by vacuum filtration, washed with water and dried in a vacuum dessicator for 16 h at 65° C. The yield of Compound (b), 3,4-dimethoxyacetanilide, was 92.8 g (49%). The $\lambda_{max}$=252 nm, Σ=13,300 and $\lambda_{max}$=289, Σ=4300 (methanol). Mass spectroscopy by FAB$^+$ (fast atom bombardment techniques) gave the expected molecular ion, m/e=196. Proton NMR was consistent with the proposed structure.

Compound (b) (45 g, 0.23M) and 250 mL of chloroform were heated in an oil bath to reflux whereupon Lawesson's Reagent (47 g, 0.17M) was added in small portions to the reaction over a period of 30 min. The reaction was allowed to reflux for 2 h and then, to cool to RT. The chloroform was vacuum filtered, poured into a 1 L separatory funnel and extracted repeatedly with 2.0 N NaOH (4×150 mL). The basic, aqueous fractions were combined. A small portion of the extract was removed and neutralized with acetic acid to pH 4. Compound(c), 3,3-dimethoxythioacetanilide, precipitated out of solution and was collected by vacuum filtration, washed with water, recrystallized from boiling ethanol and dried in a vacuum dessicator for 16 h at 65° C. The $\lambda_{max}$ =292 nm, Σ=10,300 and $\lambda_{max}$=306, Σ=10,600 (methanol). FAB$^+$ m/e=212. Proton NMR was consistent with the proposed structure and showed two isomeric forms.

A solution of potassium ferricyanide (870 mL, 20% w/w) was placed in an ice-cooled flask. The basic solution of Compound (c) was adjusted to a total volume of 800 mL with 2.0N NaOH, placed in an addition funnel and added to the ice-cooled flask at a rate slow enough to maintain the temperature of the reaction mixture between 5° C. to 10° C. After the addition was completed, the reaction warmed to RT and was stirred overnight (O/N). The reaction mixture was extracted with methylene chloride (700 mL). The organic extract was washed once with water and dried for several hours over anhydrous sodium sulfate. After drying, the sodium sulfate was filtered off and the methylene chloride was removed on a rotary evaporator to give a solid which was placed in a large vacuum sublimator, evacuated and heated to 100° C. The product sublimed onto the ice-cooled condenser over a period of about 6 h. The yield of the product, Compound (d), 5,6-dimethoxy-2-methylbenzothiazole, was about 70% (34.06 g). The $\lambda_{max}$=249 nm, Σ=10,400, $\lambda_{max}$=268, Σ=6500, $\lambda_{max}$ =96 nm, Σ=6,500, $\lambda_{max}$=307 nm, Σ=6,300 (methanol). FAB$^+$ m/e=212. Proton NMR was consistent with the proposed structure.

Compound (d) (23.2 g, 0.11M) and methyl-p-toluenesulfonate (21 g, 0.11M) were put into a flask and stirred while heated in an oil bath at 120° C. After a few minutes, the reactants melted and sulfolane (40 mL) was added as a solvent. The reaction was heated, stirred vigorously for 16 h and removed from the oil bath. While stirring vigorously, acetone (200 mL) was added to the solution. The solid that formed as the solution cooled was collected, washed with cold acetone (200 mL) and dried in a vacuum dessicator at 65° C. for 16 h. The yield of Compound (e), 5,6-dimethoxy-2,3-dimethylbenzo-thiazolium p-toluenesulfonate, was about 70% (34.06 g). The $\lambda_{max}$=264 nm, Σ=4,200 and $\lambda_{max}$=318, Σ=9,700 (methanol). FAB$^+$ m/e=25 (not including the tosylate counterion). Proton NMR was consistent with the proposed structure.

Compound (e) (45 g, 0.114M) was suspended in a flask containing chloroform (100 mL). The suspension was vigorously stirred and cooled to 5° C. using an ice bath. Freshly distilled furoyl chloride (11.19 mL, 0.114M) was added to the mixture, followed by the slow dropwise addition of triethylamine (15.9 mL, 0.114M). After the addition was completed, the reaction was stirred for an additional 30 min and the solid was collected, washed with cold chloroform (50 mL) and dried in a vacuum dessicator at 65° C. for 4 h. The yield of Compound (f) was 29.32 g (81%). FAB$^+$ m/e =317. Proton NMR was consistent with the proposed structure.

Compound (f) (29 g, 0.092M) was added to a flask containing toluene (1 L) and tetrachloroethane (350 mL).

The mixture was stirred and heated to reflux whereupon Lawesson's Reagent (18.64 g, 0.046M) was added. The reaction was stirred at reflux for 1 h and cooled with stirring to RT. The solid was collected, washed with cold toluene (100 mL) and dried in a vacuum dessicator O/N at 50° C. The yield of Compound (g) was 24.88 g (82%). $FAB^+$ m/e=334. Proton NMR was consistent with the proposed structure.

Compound (g) was suspended with stirring in dry methylene chloride (300 mL). Methyltrifluoromethanesulfonate (8.5 mL, 0.073M) was added slowly. After the addition was completed, the reaction was stirred for 20 min and the solid was collected, washed with diethyl ether (100 mL) and dried in a vacuum dessicator at 65° C. for 2 h. The yield of Compound (h) was 28.83 g (81%). $FAB^+$ m/e=349. Proton NMR was consistent with the proposed structure.

Finally, Compound (h) (4.8 g, 0.0097M) and Compound (e) (3.84 g, 0.0097M) were added to a flask containing absolute ethanol (150 mL). The suspension was stirred while triethylamine (1.36 mL, 0.0097M) was added. After the reaction mixture was stirred O/N, the solid was collected and washed with cold ethanol. The crude solid was dissolved in hot 1,1,1-trifluoroethanol (200 mL). The volume of solute was reduced to 80 mL, removed from heat and allowed to cool to RT. The crystals were collected, washed with cold trifluoroethanol and dried in a vacuum dessicator at 50° C. for 16 h. The yield of 3,3'-dimethyl-9-(2-furano)-5,6,5',6'tetramethoxy 2,2'-thiacarbocyanine trifluoromethane sulfonate after crystallization was 4.88 g (75%). The $\lambda_{max}$=615 nm, Σ=81,900 (9:1 trifluoroethanol/methanol). $FAB^+$ m/e=523 (not including the trifluoromethane sulfonate (triflate) counterion).

EXAMPLE II

Preparation of 3,3'-dimethyl-5'-chloro-9-(2-furano)-5,6,6'-trimethoxy-2,2'-thiacarbocyanine trifluoromethane sulfonate

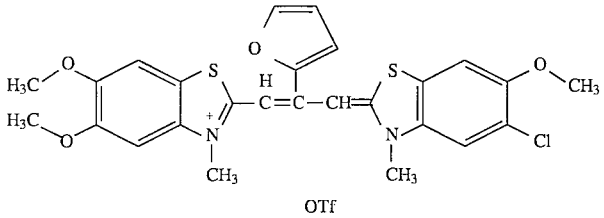

(III)

The following compounds were among those used in the example:

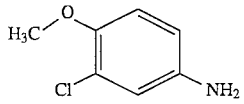
(m)

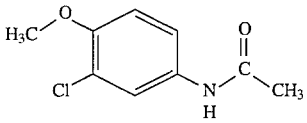
(n)

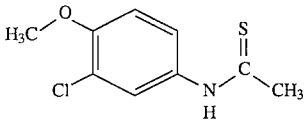
(o)

-continued

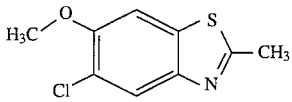
(p)

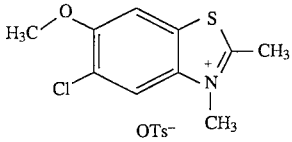

(q)

Compound (m) (102.42 g, 0.650M, 3-chloro-4-methoxyaniline) was dissolved in dimethylformamide (200 mL). Acetic anhydride (61.26 mL) was added to the solution and the resultant mixture was stirred at RT for 16 h. The workup procedure was the same as that used to make Compound (b) as described in Example I herein. The overall yield of Compound (n), based upon 90% pure starting material was 106.63 g (92%), m.p. 40°–42° C. $FAB^+$ m/e=200. Proton NMR was consistent with the proposed structure.

Compound (n) (50 g, 0.25M) was put into chloroform (250 mL), followed by Lawesson's Reagent (50.6 g, 0.125M). The procedure followed was the same as that for Compound (c) as described in Example I herein. The product was carried on to the next step as a solution in 2.0N NaOH. A sample was removed, neutralized with acetic acid to pH 3.5 and crystallized from hot ethanol, m.p. 83°–85° C. $FAB^+$ m/e=215. Proton NMR was consistent with the proposed structure of Compound (o), 3-chloro-4-methoxythioacetanilide, and showed two isomeric (cistrans) forms.

A solution of potassium ferricyanide (900 mL, 20% w/w) was placed into an ice-cooled flask. The sodium hydroxide solution containing Compound (o) was adjusted to a volume of 800 mL by the addition of 2.0N NaOH at a rate slow enough to maintain the temperature of the reaction mixture in the flask between 5° C. to 10° C. The rest of the procedure followed was the same as that used to make Compound (d) as described in Example I herein. The yield of Compound (p), 5-chloro-6-methoxybenzothiazole, based upon the amount of starting material used to make Compound (n), was 9.1 g (17%), m.p. 71°–73° C. $FAB^+$ m/e=214. Proton NMR was consistent with the proposed structure.

The quaternization reaction and workup was done according to the same method used to make Compound (e), as described in Example I herein, starting with Compound (p) (9.1 g, 0.043M), methyl-p-toluenesulfonate (8.0 g, 0.043M) and sulfolane (20 mL). The yield of Compound (q), 5-chloro-6-methoxy-2,3-dimethylbenzothiazolium p-toluenesulfonate, was 13.8 g (80%). $FAB^+$ m/e=229 (not including the p-toluene sulfonate (tosylate) counterion). Proton NMR was consistent with the proposed structure.

Finally, Compound (q) (3.85 g, 0.0097M) and Compound (h) (4.8 g, 0.0097M) were combined in absolute ethanol (200 mL), followed by the addition of triethylamine (1.36 mL, 0.0097M). The isolation and purification was essentially the same as that for 3,3'-dimethyl-9-(2-furano)-5,6,5',6'-tetramethoxy 2,2'-thiacarbocyanine trifluoromethane sulfonate as described in Example 1 except that three recrystallizations from trifluoroethanol were required to bring the dye purity to 97%. The yield of 3,3'-dimethyl-5'-chloro-9-(2-furano)-5,6,6'-trimethoxy-2,2'-thiacarbocyanine trifluoromethane sulfonate was 5.37 g (55%). The $\lambda_{max}$=604 nm, Σ=81,200 (9:1 trifluoroethanol/methanol). $FAB^+$ m/e=527 (not including the triflate counterion).

As mentioned earlier, all the compounds prepared above gave the correct molecular ion as determined by FAB. High Pressure Liquid Chromatography (HPLC) was used to ascertain purity of the dyes as well as to monitor progress of some of the reactions. Chromatography was performed on a C-18 reverse phase o column using methanol/water as the eluent. In analyzing the anionic dyes, an ion pairing reagent (tert-butylammonium phosphate-0.002M) was used to better retain the dye on the column as well as to reduce tailing. In the case of a zwitterionic dye, the ion pairing reagent was unnecessary. Since cationic dyes adsorbed too strongly to the C-18 reverse phase column to be eluted, thin layer chromatography (TLC) on silica 5% methanol/methylene chloride was used for these dyes instead of HPLC.

EXAMPLE III

Photographic light-sensitive silver halide emulsions wherein the silver grains are spectrally sensitized to near infrared radiation at wavelengths above 700 nm with a J-band type sensitizing dye according to formula (I) herein The following dyes were used in this Example:

DYE-1

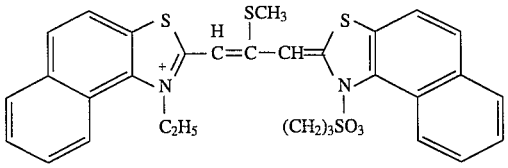

DYE-2

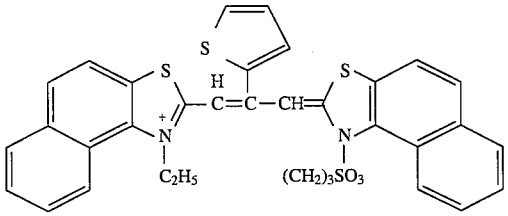

DYE-3

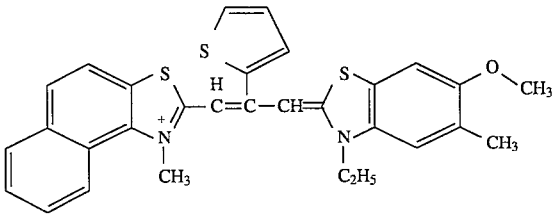

DYE-4

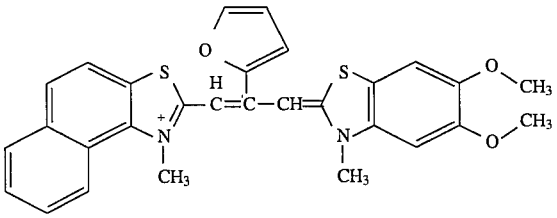

DYE-5

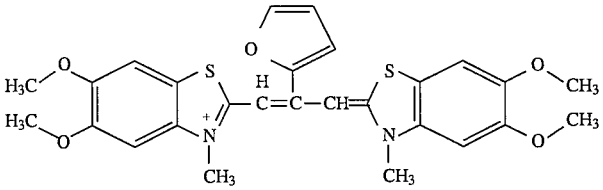

-continued

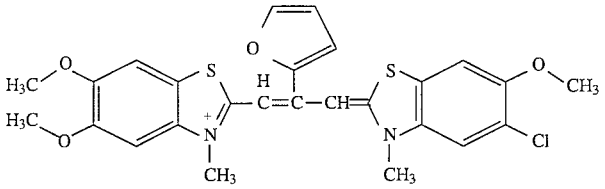

DYE-6

A comparison of the relative speeds and stabilities for DYES 1–3 (used singly in the art) and DYES 4–6 (according to formula (I) of the present invention) is shown in Table I below.

DYES 1–6 were dissolved in trifluoroethanol/methanol (1:9) and the dye solutions were added with stirring to a gelatino silver iodobromide emulsion (1.3 mol % iodide, 1.55 microns, polydispersed with a preponderance of high index faces) containing 4'-methylphenylhydroquinone. DYES 1–6 were added to the emulsion at a level of 1.0 mg DYE per gram of silver.

Each emulsion was coated on a transparent polyethylene terephthalate film base at a coverage of 1.2 to 1.3 g silver/$m^2$ and 3.0 g gelatin/$m^2$. A protective layer comprising 300 mg/$m^2$ gelatin was coated over the emulsion. The photosensitive elements were air-dried at RT.

The photosensitive elements were placed in gray and black photographic bags and stored at RT in a chamber for 3 to 6 days with or without 300 psi of oxygen pressure. After equilibration of the oxygen-bombed photosensitive elements to standard pressure, all of the photosensitive elements were exposed in a wedge spectrograph having a range of wavelengths from 400 to 850 nm. The speeds of the photosensitive elements were determined by using calibrated step targets, i.e., 5 nm increments in the region from 650 to 850 nm, and reading the photosensitive elements in an automatic reading densitometer. Table I reports the speeds for the various photosensitive elements at the desired wavelengths, i.e., 710 and 720 nm.

The change in speed (A SPD) data of Table I represent the loss of speed between two identical coatings: (1) a "control" held at RT and pressure (C-SPD) and (2) a "test" subjected to accelerated aging in an oxygen bomb for 3 days at 300 p.s.i. prior to exposure. $\lambda_{max}$(soln) is the wavelength at which the dye exhibits maximum absorption in the visible region in a solvent or solution, in this experiment, 10% trifluoroethanol/90% methanol. DYE—1 has two values for $\lambda_{max}$(soln), i.e., 578 and 636 nm, because of its double-peaked main absorbance in the visible region.

TABLE I

| Dye | $\lambda_{max}$ (soln) | C-SPD 710 | Δ SPD 710 | C-SPD 720 | Δ SPD 720 |
|---|---|---|---|---|---|
| DYE-1 | 578 nm & 636 nm | 2.06 | −0.62 | 1.64 | −0.66 |
| DYE-2 | 614 nm | 1.62 | −0.54 | 0.93 | −0.54 |
| DYE-3 | 602 nm | 1.44 | −0.15 | 0.54 | −0.16 |
| DYE-4 | 615 nm | 1.18 | −0.12 | 1.04 | −0.12 |
| DYE-5 | 615 nm | 1.53 | −0.09 | 1.46 | −0.09 |
| DYE-6 | 605 nm | 2.01 | −0.06 | 1.83 | −0.05 |

The magnitude of the speed loss between the control and the test coatings was used to assess the stability of the dyes, with a −0.30 speed decrease equal to the loss of one-stop. Furthermore, a stable, commonly used red sensitizing dye, i.e., DYE—7 below

DYE-7

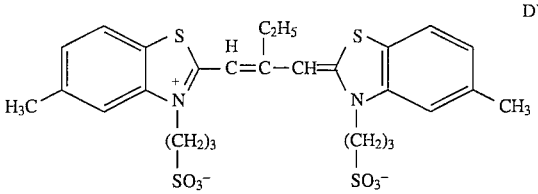

when subjected to the same regimen as the test coating, showed a speed loss (at its respective peaks) of about no more than −0.12 units (as did other stable, commonly used dyes); therefore, it is apparent from the data of Table I that DYES 4–6 which exhibited speed losses equal to or less than DYE—7 were stable dyes.

As can be seen from the results tabulated above, the emulsions containing the meso-furan dye compounds of the present invention, i.e., DYES 4–6, exhibit good speed and stability at both 710 and 720 nm. Moreover, the dye of Example II herein, i.e., 5'-chlorine (DYE—6), though being shorter in solution than the dye of Example I herein (DYE—5) by 10 nm, aggregated to give longer spectral characteristics, i.e., a more red absorption, and resulted in higher speeds and better stabilities of the sensitized materials at both 710 and 720 nm.

Accordingly, the data of Table I indicate that photographic light-sensitive silver halide emulsions wherein the silver halide grains are spectrally sensitized to near infrared with a J-band type sensitizing dye according to formula (I), e.g., DYE—4, DYE—5 or DYE—6, exhibit desirable extents of sensitization, i.e., very good speed and stability at 710 and 720 nm. In contrast, Table I also indicates: (1) the very good speed yet poor stability of DYE—1, (2) the good speed yet poor stability of DYE—2 and (3) the poor speed yet good stability of DYE—3.

Therefore, as illustrated by the data of Table I, the dyes according to formula (I) of the present invention may be used to spectrally sensitize the silver grains of photographic light-sensitive silver halide emulsions to near infrared radiation at wavelengths above 700 nm without compromising the speed and stability of the dyes.

Since certain changes may be made in the above subject matter without departing from the scope of the invention herein involved, it is intended that all matter contained in the above description shall be interpreted as illustrative and not in a limiting sense.

What is claimed is:

1. A light-sensitive photographic silver halide emulsion spectrally sensitized to near infrared radiation above about 700 nm with a sensitizing dye represented by the formula

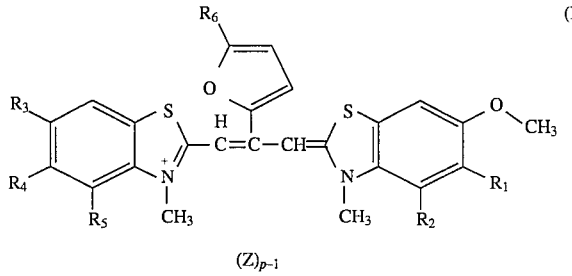

(I)

wherein:

$R_1$ is methoxy or halogen;

$R_2$ is hydrogen;

$R_3$ is hydrogen or methoxy;

$R_4$ is methoxy;

$R_5$ is hydrogen;

$R_6$ is hydrogen or an alkyl group ($C_nH_{2n+1}$) wherein n is an integer from 1 to 4;

$R_1$ and $R_2$ or $R_4$ and $R_5$, taken together, can represent a saturated or unsaturated, 5- or 6-membered carbocyclic or heterocyclic ring wherein the heteroatom is sulfur or oxygen;

Z is a photographically-acceptable counterion as needed to balance the charge of the molecule; and p is 1 when the molecule is not positively charged; or p is greater than 1 when the molecule is positively charged.

2. An emulsion according to claim 1 wherein said $R_1$, $R_3$ and $R_4$ are methoxy, $R_2$, $R_5$ and $R_6$ are hydrogen and p is 1.

3. An emulsion according to claim 1 wherein said $R_1$ is halogen, $R_3$ and $R_4$ are methoxy, $R_2$, $R_5$ and $R_6$ are hydrogen and p is 1.

4. An emulsion according to claim 3 wherein said halogen is chloride.

5. An emulsion according to claim 1 wherein said $R_1$ and $R_2$, taken together, represent an unsaturated 6-membered carbocyclic ring.

6. An emulsion according to claim 1 wherein said $R_4$ and $R_5$, taken together, represent an unsaturated 6-membered carbocyclic ring.

7. An emulsion according to claim 6 wherein said $R_1$ is methoxy, $R_2$, $R_5$ and $R_6$ are hydrogen and p is 1.

8. An emulsion according to claim 1 wherein said Z is selected from the group consisting of sodium, potassium, ammonium, iodide, bromide, p-toluene sulfonate, triethylammonium, triethanolammonium, trifluoromethane sulfonate and pyridinium.

9. An emulsion according to claim 8 wherein said Z is p-toluene sulfonate.

10. An emulsion according to claim 8 wherein said Z is trifluoromethane sulfonate.

11. A photosensitive element comprising a support carrying a silver halide emulsion, said silver halide emulsion being spectrally sensitized to near infrared radiation above about 700 nm with a sensitizing dye represented by the formula

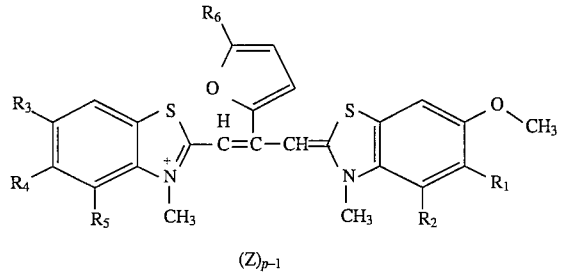

(I)

wherein:

$R_1$ is methoxy or halogen;

$R_2$ is hydrogen;

$R_3$ is hydrogen or methoxy;

$R_4$ is methoxy;

$R_5$ is hydrogen;

$R_6$ is hydrogen or an alkyl group ($C_nH_{2n+1}$) wherein n is an integer from 1 to 4;

$R_1$ and $R_2$ or $R_4$ and $R_5$, taken together, can represent a saturated or unsaturated, 5- or 6-membered carbocyclic or heterocyclic ring wherein the heteroatom is sulfur or oxygen;

Z is a photographically-acceptable counterion as needed to balance the charge of the molecule; and p is 1 when the molecule is not positively charged; or p is greater than 1 when the molecule is positively charged.

12. A photosensitive element according to claim 11 wherein said $R_1$, $R_3$ and $R_4$ are methoxy, $R_2$, $R_5$ and $R_6$ are hydrogen and p is 1.

13. A photosensitive element according to claim 11 wherein said $R_1$ is halogen, $R_3$ and $R_4$ are methoxy, $R_2$, $R_5$ and $R_6$ are hydrogen and p is 1.

14. A photosensitive element according to claim 13 wherein said halogen is chloride.

15. A photosensitive element according to claim 11 wherein said $R_1$ and $R_2$, taken together, represent an unsaturated 6-membered carbocyclic ring.

16. A photosensitive element according to claim 11 wherein said $R_4$ and $R_5$, taken together, represent an unsaturated 6-membered carbocyclic ring.

17. A photosensitive element according to claim 16 wherein said $R_1$ is methoxy, $R_2$, $R_5$ and $R_6$ are hydrogen and p is 1.

18. A photosensitive element according to claim 11 wherein said Z is selected from the group consisting of sodium, potassium, ammonium, iodide, bromide, p-toluene sulfonate, triethylammonium, triethanolammonium, trifluoromethane sulfonate and pyridinium.

19. A photosensitive element as defined in claim 11 including a layer containing an image dye-providing material positioned between said support and said silver halide emulsion.

20. A photographic product comprising a photosensitive element as defined in claim 11; a second, sheet-like element in superposed or superposable position with respect to said silver halide emulsion; a rupturable container releasably holding a processing composition and positioned to release said composition for distribution between said elements; said photosensitive element or said second, sheet-like element containing an image-receiving layer for receiving by diffusion transfer an imagewise distribution of diffusible image-forming material formed in said photosensitive element following distribution of said processing composition.

21. A photographic product as defined in claim 20 wherein said diffusible image-forming material forms a transfer image in silver.

22. A photographic product as defined in claim 20 wherein said diffusible image-forming material forms a transfer image in dye.

23. A photographic product as defined in claim 20 wherein said photosensitive element comprises, in sequence on said support, a layer of a cyan image dye-providing material, a silver halide emulsion spectrally sensitized to infrared radiation with said sensitizing dye, a layer of a magenta image dye-providing material, a layer of a red-sensitive silver halide emulsion, a layer of a yellow image dye-providing material, and a layer of a blue sensitive silver halide emulsion.

24. A photographic product as defined in claim 23 wherein said cyan image dye-providing material is a dye developer, said magenta image dye-providing material is a dye developer and said yellow image dye-providing material is a thiazolidine.

25. A photographic product as defined in claim 21 further including a reducing agent and wherein said image-receiving layer comprises silver precipitating nuclei.

* * * * *